US006508635B2

(12) United States Patent
Kueon

(10) Patent No.: US 6,508,635 B2
(45) Date of Patent: Jan. 21, 2003

(54) EXHAUSTING SPRING STRUCTURE FOR HIGH-PRESSURE DISCHARGING PIPE OF COMPRESSOR

(75) Inventor: Young-su Kueon, Kwangju (KR)

(73) Assignee: Samsung Kwangju Electronics Co., Ltd. (KR)

( * ) Notice: Subject to any disclaimer, the term of this patent is extended or adjusted under 35 U.S.C. 154(b) by 0 days.

(21) Appl. No.: 09/836,265

(22) Filed: Apr. 18, 2001

(65) Prior Publication Data

US 2002/0009370 A1 Jan. 24, 2002

(30) Foreign Application Priority Data

Jun. 13, 2000 (KR) ..... 2000-32496

(51) Int. Cl.[7] ..... F04B 39/00; F04B 53/00

(52) U.S. Cl. ..... 417/312; 417/53; 417/902; 181/207; 181/228

(58) Field of Search ..... 417/53, 312, 902, 417/416, 417; 181/207, 209, 229, 228, 279

(56) References Cited

U.S. PATENT DOCUMENTS 3,586,456 A * 6/1971 Giacosa ..... 417/312
4,091,892 A * 5/1978 Henmann et al. ..... 181/286
4,477,229 A * 10/1984 Kropiwnicki et al. ..... 417/53
4,854,416 A * 8/1989 Lalikos et al. ..... 181/207
5,210,382 A * 5/1993 Paley et al. ..... 181/209
H1317 H * 6/1994 Ng ..... 181/207
5,743,298 A * 4/1998 Whitesell ..... 138/31
6,092,999 A * 7/2000 Lilie et al. ..... 417/415
6,273,688 B1 * 8/2001 Kawahara et al. ..... 417/417

* cited by examiner

*Primary Examiner*—Charles G. Freay
*Assistant Examiner*—Han L. Liu
(74) *Attorney, Agent, or Firm*—Burns Doane Swecker & Mathis, LLP

(57) ABSTRACT

A reciprocating compressor includes a piston reciprocating within a cylinder to compress a fluid. The compressed fluid is discharged through a discharge pipe which is susceptible to being vibrated, e.g., by the operation of a motor of the compressor. To attenuate such vibrations, an anti-vibration coil spring is mounted to the discharge pipe, with the discharge pipe passing through helical turns of the spring. The helical turns define respective outer diameters which are non-uniform along the length of the spring.

3 Claims, 2 Drawing Sheets

Fig. 4
PRIOR ART
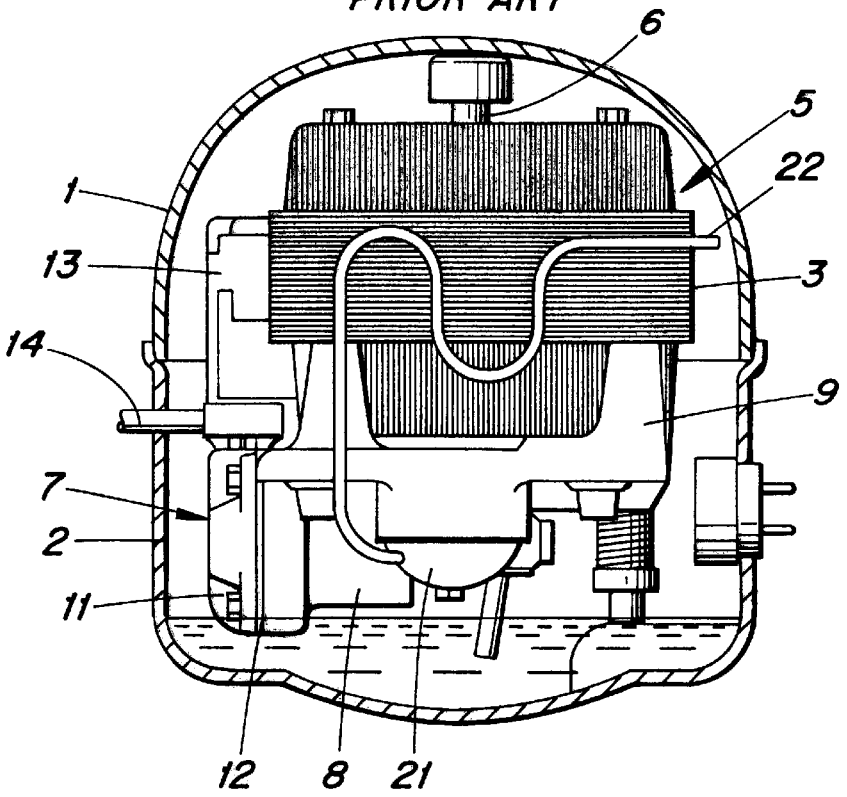
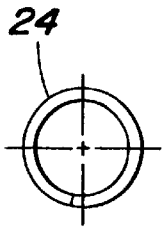
Fig. 5a
PRIOR ART
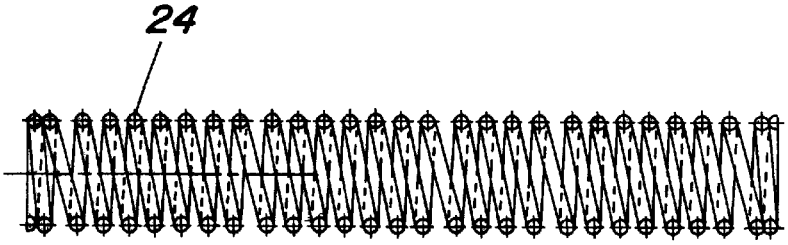
Fig. 5b
PRIOR ART

EXHAUSTING SPRING STRUCTURE FOR HIGH-PRESSURE DISCHARGING PIPE OF COMPRESSOR

This application claims priority under 35 U.S.C. §119 and/or 365 to Patent Application Serial No. 32496/2000 filed in the Republic of Korea on Jun. 13, 2000, the entire content of which is hereby incorporated by reference.

BACKGROUND OF THE INVENTION

1. Field of the Invention

The present invention relates to a high-pressure discharging pipe of a reciprocating motion compressor as a discharging way of compressed coolant from the compressor, and more particularly to a structure of the exhausting spring for the high-pressure discharging pipe for reducing vibration of the high-pressure discharging pipe, a vibrating noise of the compressor simultaneously and improving a confidence by progressing the exhaust in the high-pressure pipe while avoiding peculiar frequency generated from a predetermined rpm of the compressor.

2. Description of the Background Art

A closed compressor generally includes an electric system 5 having a stator 3 and a rotor (not shown) inside the upper and lower containers 1 and 2, and a compressing system 7 discharging coolant after sucking and compressing by a rotating motion of a crankshaft 6 which is indentation-fixed on a center of the rotor as shown in FIG. 4.

The compressing system 7 includes a cylinder block 9 unified with a cylinder 8 forming an exhausting space of the coolant, a piston (not shown) coupled with the crank shaft 6 for reciprocatively moving in a straight line inside the cylinder 8, a cylinder head 11 fixed on an end of the cylinder 8 and a valve device 12 for sucking the coolant into the cylinder 8 and discharging the compressing coolant lain between the cylinder 8 and the cylinder head 11.

A sucking muffler 13 having a stated shape on the upper part of the cylinder head 11 is fixed with the stator 3 and coupled with a sucking pipe 14 penetrated through the lower container 2.

The above-described general closed compressor repeats the following discharging steps. Sucked coolant passed through the sucking pipe 14 passes through the sucking muffler 13, the cylinder head 11 and the valve device 12, and then flows into the cylinder 8 in the sucking step. The sucked coolant is compressed by a reciprocating motion in a straight line of a piston according to a rotation of the crankshaft 6 in the compressing step. The coolant compressed in the cylinder 8 is discharging to outside according to the course of discharging through the valve 12 and the cylinder head 11 again in the discharging step.

In the discharging step, a half-circular discharging muffler 21 is mounted on the lower side of the cylinder block 9 and connected to the discharging space of the cylinder head 11 for conducting the discharged coolant.

A high-pressure discharging pipe 22 is connectedly fixed to the discharging muffler 21 as a shape of surrounding the stator 3 and one end of the high-pressure discharging pipe 22 is fixed by welding to a fixed discharging pipe (not shown) for penetrating through the lower container 2.

Accordingly, the coolant compressed inside the cylinder 8 flows into the discharging muffler 21 after passing through the discharging space of the cylinder head 11 and escapes from the closed compressor through the discharging pipe after passing the high-pressure discharging pipe 22.

At this time, the compressed coolant generates a vibration when passing through the high-pressure discharging pipe that is comparatively narrow and, the vibration is manifested as periodic noise or vibration of specified frequency by converting to a vibrating sound wave. Thus, a cylindrical exhausting spring 24 is formed for coupling on the outer surface of the high-pressure discharging pipe as long as a required length for reducing the noise or vibration.

The cylindrical exhausting spring 24 strengthens the mass of the high-pressure pipe and performs to reduce vibrating noise during the exhausting process.

However, there is no concrete means to improve a vibrating problem of a specified problematic frequency band generated in using the cylindrical exhausting spring 24. Only a variation of the problematic frequency band is observed by a minute control of the wire diameter, inner diameter or pitch of the spring. The maximum vibration plan is difficult as much as like that which one may be shown as an improved vibrating effect of the practical problematic frequency among the plurality of designing factors.

The cylindrical exhausting spring 24 used for the existing high-pressure discharging pipe was not an active vibration reducing method to improve the definite problematic frequency band.

SUMMARY OF THE INVENTION

To resolve the above problems, it is an object of the present invention to provide an exhausting structure for a high-pressure discharging pipe of a compressor for reducing vibration of the high-pressure discharging pipe, an vibrating noise of the compressor simultaneously and improving a confidence by progressing the exhaust in the high-pressure pipe while avoiding a peculiar frequency generated from a predetermined revolution times (for example, 3800 rpm) of the compressor through applying an uneven-diameter exhausting spring 25 capable of reducing the vibration transferred to the high-pressure discharging pipe of the compressor.

The exhausting spring functions as an anti-vibration spring in a high-pressure discharging pipe of a compressor whose operation comprises the steps of inducing a suction for flowing a coolant sucked through an sucking pipe into a cylinder after passing through an sucking muffler, a cylinder head and a valve device; inducing a compression for compressing said sucked coolant by a reciprocating motion of a piston in a straight line according to a rotation of a crankshaft; and a discharging step for discharging said compressed coolant from inside the cylinder to the outside according to a course of discharging through the valve device and the cylinder head, wherein the anti-vibration spring acting as a mass member is mounted to reduce noise or vibration on the outer surface of the high-pressure discharging pipe body that is the discharging path of the compressed coolant and controls the mass by having a non-uniform diameter along the length of the anti-vibration spring.

BRIEF EXPLANATION OF THE DRAWINGS

The above objectives and advantages will become more apparent with the following explanation made with reference to the accompanying drawings, in which:

FIG. 4 is a cross-sectional view of an internal structure of a prior art closed compressor in general;

FIG. 5*a* illustrates a side view of a prior art cylindrical exhausting spring for a high-pressure discharging pipe of a closed compressor in general; and FIG. 5*b* illustrates an end view of the prior art spring of FIG. 5*a*.

DETAILED DESCRIPTION OF PREFERRED EMBODIMENTS OF THE INVENTION

Figure 1:
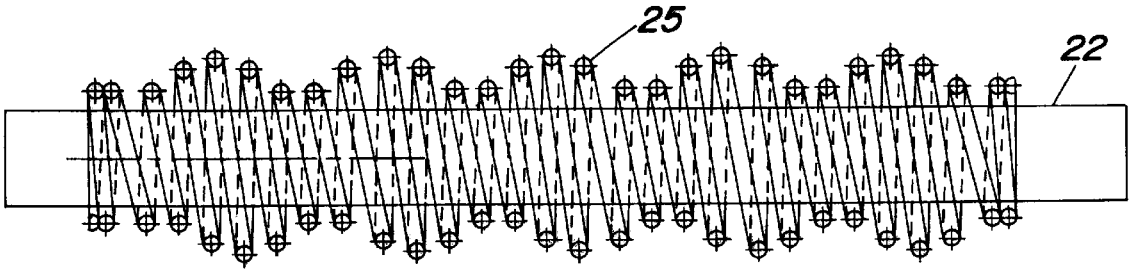
FIG. 1 illustrates an uneven-diameter exhausting spring for a high-pressure discharging pipe according to the present invention.

The structure of the present invention will now be explained in detail with reference to the accompanying drawings.

FIG. 4 illustrates a cross-sectional view of the internal structure of the general closed compressor. The compressor repeats the following discharging steps. In the sucking step, sucked coolant passed through the sucking pipe 14 passes by the sucking muffler 13, the cylinder head 11 and the valve device 12, and then flows into the cylinder 8. In the compressing step, the sucked coolant is compressed by a reciprocating motion in a straight line of a piston according to a rotation of the crankshaft 6. In the discharging step, the coolant compressed in the cylinder 8 is discharging to outside according to the course of discharging through the valve 12 and the cylinder head 11 again.

A half-circular discharging muffler 21 is mounted on the lower side of the cylinder block 9 and connected to the discharging space of the cylinder head 11 for passing through.

Accordingly, the coolant compressed inside the cylinder 8 flows into the discharging muffler 21 after passing through the discharging space of the cylinder head 11 and escapes from the closed compressor through the discharging pipe after passing the high-pressure discharging pipe 22.

FIG. 1 illustrates an uneven-diameter exhausting spring 25 for the high-pressure discharging pipe according to the present invention.

Referring to FIG. 1, the uneven-diameter exhausting spring 25 is applied to the high-pressure discharging pipe 22, which is a discharging path of the compressed coolant. The spring has a plurality of helical turns defining respective external diameters. The discharging pipe 22 passes through the turns. The diameters of the turns are non-uniform along the spring length as can be seen in FIG. 1.

Figure 2:
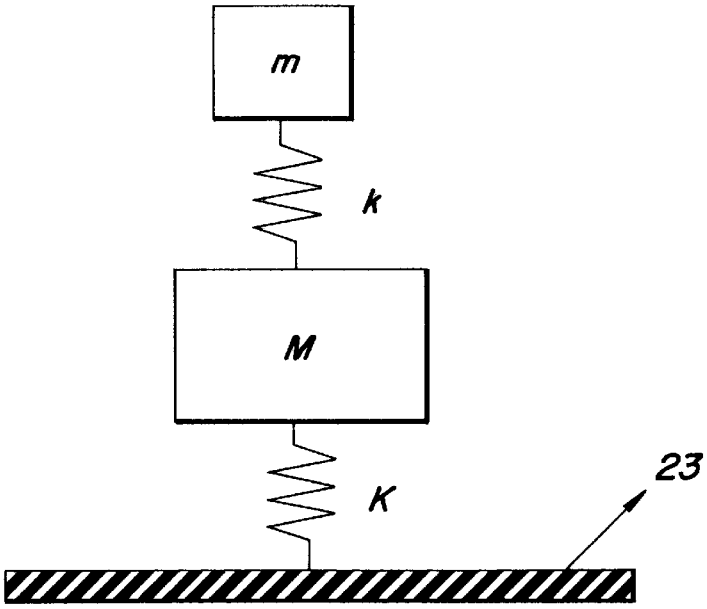
FIG. 2 is a view illustrating a principle of a vibrating exhausting device according to the present invention.

FIG. 2 is a view illustrating a principle of a vibrating exhausting device according to the present invention.

Referring to FIG. 2, the principle of the vibrating exhausting device is constructed for sucking peculiar vibration of regular frequency transmitted to a first Mass M by a second mass m. That is, M never vibrates when synchronizing a peculiar frequency (Equation 1) of m and k vibrating systems with problematic frequency (*f*)

$$f_2 = \left(\frac{1}{2}\pi\right)\sqrt{\frac{k}{m}} \quad \text{(k = vibration coefficient, m = second mass)} \qquad \text{[Equation 1]}$$

A principle of the vibrating exhausting device is applied to the uneven-diameter exhausting spring.

That is, when exciting force is added to the mass M in the second induced vibrating system without having attenuation and the mass m does not exist, the mass M receives all the vibration of an exciting factor 23.

Without the mass m,

Exciting factor 23=pulsation of compressor

M=high-pressure discharging pipe and cylindrical exhausting spring for high-pressure discharging pipe The pulsation of the compressor is directly transferred to the discharging pipe of the compressor after passing the high-pressure discharging pipe. (Operating as one mass due to a close adhesion to the high-pressure discharging pipe.)

When the mass m exists, all exciting force of the exciting factor is sucked for vibrating but not transmitted to the mass M.

With the mass m,

Exciting factor 23=pulsation of compressor m=uneven-diameter exhausting spring for high-pressure discharging pipe The pulsation of the compressor vibrates the mass m through the high-pressure discharging pipe but the high-pressure discharging pipe itself does not vibrate, therefore, the pulsation is transmitted to the discharging pipe of the compressor. (Operating separately as two masses by loosely assembling the spring for the high-pressure discharging pipe.)

The pulsation of the compressor is periodically generated by a rotation of a motor, which becomes the cause of having a definite problematic frequency for almost the vibration of the compressor.

In a vibration mode of the high-pressure discharging pipe, the pipe severely vibrates at the frequency corresponding to double of a power frequency and several specified problematic frequencies are generated.

When a specified problematic frequency band of the high-pressure discharging pipe is over vibrated and makes a resonance, as shown in FIG. 1, an exhausting coil part of the high-pressure discharging pipe is separately vibrated without any relationship to the high-pressure discharging pipe if the uneven-diameter coil part of the high-pressure discharging pipe is of larger diameter than the high-pressure discharging pipe.

Figure 3:
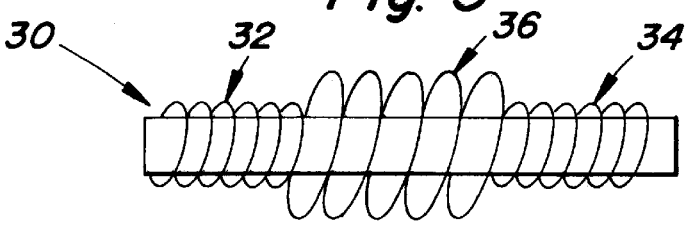
FIG. 3 illustrates an expanded-type of an exhausting spring for the high-pressure discharging pipe according to another embodiment of the present invention.

In the spring according to FIG. 1, the external diameters gradually increase and then decrease a number of times along the length of the exhausting spring 25. In the spring 30 according to FIG. 3, the turns comprise first and second groups 32, 34 of turns disposed adjacent respective ends of the spring, and a third group of turns 36 disposed between the first and second groups. The turns of the third group 36 have larger outer diameters than the turns of the first and second groups.

The variations m and k are changed by controlling the outer diameters of the coil turns and the wire diameter of the exhausting coil part so that the problematic frequency band of the high-pressure discharging pipe offsets the resonance.

Therefore, the uneven-diameter exhausting spring may be designed to vibrate without vibration of the high-pressure discharging pipe by controlling the mass of the uneven-diameter exhausting spring for fitting with the specified problematic frequency band, the wire diameter of the factor for rigidity and the size of the diameter unevenness.

As explained in the above, the exhausting spring structure for the high-pressure discharging pipe of the compressor according to the present invention may reduce the resonance generated from the high-pressure discharging pipe and the vibration of the specified problematic frequency band by installing the uneven-diameter exhausting spring on the high-pressure discharging pipe which is the discharging path of the compressed coolant. And the exhausting spring structure may ultimately contribute to the compressor having low-vibration and low-noise.

While the present invention has been described herein with reference to particular embodiments thereof, a latitude of modification, various changes and substitutions are intended in the foregoing disclosure. In some instances, some features of the invention will be employed without a corresponding use of other features without departing from the spirit of the invention as set forth herein.

What is claimed is:

1. A compressor comprising:

a cylinder head forming a cylinder having a valved inlet and a valved outlet;

a suction pipe and a discharge pipe communicating with the valved inlet and the valved outlet, respectively, for conducting a fluid medium respectively to and from the cylinder;

a piston reciprocably movable within the cylinder to compress the fluid medium and discharge it though the discharge opening;

a driven crankshaft for reciprocating the piston; and an anti-vibration coil spring mounted to the discharge pipe which extends through helical turns of the coil spring, the helical turns defining respective outer diameters, wherein the outer diameters are non-uniform along a length of the spring for reducing noise and vibration of the discharge pipe.

2. The compressor according to claim 1 wherein the outer diameters gradually increase and then gradually decrease a number of times along the length of the spring.

3. The compressor according to claim 1 wherein the turns comprise first and second groups of turns disposed adjacent respective ends of the spring, and a third group of springs disposed between the first and second groups, the turns of the third group having larger outer diameters than the turns of the first and second groups.

* * * * *